US012402771B2

(12) United States Patent
Dirnberger et al.

(10) Patent No.: US 12,402,771 B2
(45) Date of Patent: Sep. 2, 2025

(54) DOMESTIC DISHWASHING MACHINE

(71) Applicant: emz-Hanauer GmbH & Co. KGaA, Nabburg (DE)

(72) Inventors: Albert Dirnberger, Neunburg vom Wald (DE); Matthias Bauer, Schmidgaden (DE); Benjamin Schemela, Schwarzenbach (DE)

(73) Assignee: emz-Hanauer GmbH & Co. KGaA, Nabburg (DE)

( * ) Notice: Subject to any disclaimer, the term of this patent is extended or adjusted under 35 U.S.C. 154(b) by 268 days.

(21) Appl. No.: 18/113,155

(22) Filed: Feb. 23, 2023

(65) Prior Publication Data

US 2023/0292980 A1 Sep. 21, 2023

(30) Foreign Application Priority Data

Mar. 18, 2022 (DE) ..... 102022106458.1

(51) Int. Cl.
*A47L 15/42* (2006.01)

(52) U.S. Cl.
CPC ..... *A47L 15/4259* (2013.01); *A47L 15/4263* (2013.01)

(58) Field of Classification Search
CPC ..... A47L 15/4259
See application file for complete search history.

(56) References Cited

U.S. PATENT DOCUMENTS

2018/0000312 A1* 1/2018 Dirnberger ..... E05C 19/02
2018/0368652 A1* 12/2018 Krieger ..... E05C 5/00

FOREIGN PATENT DOCUMENTS

DE 102006037494 A1 2/2008
DE 102016008044 A1 1/2018

* cited by examiner

*Primary Examiner* — Michael E Barr
*Assistant Examiner* — Kevin G Lee
(74) *Attorney, Agent, or Firm* — Tarolli, Sundheim, Covell &Tummino LLPL

(57) ABSTRACT

A domestic dishwashing machine includes a machine body having a dishwashing chamber formed therein, a door that is held on the machine body so as to be pivotable about a horizontal pivot axis, and a door latch. The door latch includes a latch assembly arranged on the machine body and which has a movably arranged closing member and a closing spring arrangement, and an engagement structure arranged on the door, wherein, on closing of the door, the closing member comes into closing engagement with the engagement structure, and a pulling-shut action can be exerted on the door by relaxation of the closing spring arrangement. The door has an internal door lining made of sheet-metal material which extends to a door top edge. The door lining has a first lining wall portion arranged adjacent to the door top edge and extending substantially parallel to the door plane.

9 Claims, 4 Drawing Sheets

DOMESTIC DISHWASHING MACHINE

CROSS-REFERENCE TO RELATED APPLICATIONS

This application claims priority to German Patent Application 10 2022 106 458.1, filed on Mar. 18, 2022, the contents of which is incorporated by reference herein.

FIELD

The invention relates to a domestic dishwashing machine which allows a door of the dishwashing machine to be produced with a reduced thickness.

BACKGROUND

In dishwashing machines for domestic use, a dishwashing chamber with as large a volume as possible is often desirable in order to be able to clean as many dishes as possible in an operating cycle of the dishwashing machine. For the external dimensions of a dishwashing machine, manufacturers often comply with specific standardized maximum values, in particular in the case of built-in appliances. This allows models from different manufacturers to be installed in a niche of a standard size. In order nevertheless to increase the volume of the dishwashing chamber, consideration can be given to designing the door of the dishwashing machine with a reduced thickness, so as to create more space in the depth of the dishwashing chamber for accommodating dishes. However, a reduced door thickness can lead to difficulties when adopting conventional door latch concepts. Dishwashing machines are generally designed with a door latch. The purpose of the door latch is to hold the door closed after it has been closed by hand. To that end, the door latch comprises latch components, of which some are generally arranged on the door and others are arranged on a machine body of the dishwashing machine, on which the door is pivotably mounted. If the thickness of the door is reduced, it can, for example, happen—should it be desired to adopt conventional latch concepts without adaptation measures—that the door no longer closes tightly. Reliable sealing of the dishwashing chamber against the escape of liquid or hot steam is, however, essential in a dishwashing machine for domestic use.

SUMMARY

An object of the invention is, therefore, to provide a domestic dishwashing machine which ensures a reliable latching function for a door of the machine even with a reduced door thickness.

In order to achieve this object, the invention provides a domestic dishwashing machine, comprising a machine body having a dishwashing chamber formed therein, a door mounted on the machine body so as to be pivotable about a horizontal pivot axis, and a door latch. The door latch comprises a latch assembly which is arranged on the machine body and which has a movably arranged closing member and a closing spring arrangement, and an engagement structure arranged on the door. On closing of the door, the closing member comes into closing engagement with the engagement structure, wherein a pulling-shut action can be exerted on the door by relaxation of the closing spring arrangement. The door comprises an internal door lining made of sheet-metal material which reaches to a door top edge. The door lining has a first lining wall portion arranged adjacent to the door top edge and extending substantially parallel to the door plane, adjoining which, in the direction towards a door bottom edge, there is a second lining wall portion extending transverse, in particular substantially perpendicular, to the door plane in the direction away from the door. According to the invention there is provided in the height region of the first lining wall portion, in a part of the door that is covered by the door upper edge, an insertion space which allows the closing member to be inserted into the insertion space on closing of the door.

The presence of the insertion space allows the engagement structure to be displaced in the direction towards the front side of the door. A configuration of the door with a reduced thickness is thereby made possible.

In accordance with another approach, the mentioned object can be achieved in that there is formed in the door lining an opening in which an insert part made, for example, of a plastics material and carrying the engagement structure is held. The opening is here formed at least in part in the first lining wall portion. In some embodiments, the opening extends from the first lining wall portion into the second lining wall portion.

In accordance with yet a further approach, the mentioned object can be achieved in that, according to the invention, the engagement structure is formed by an engagement depression which is recessed relative to the second lining wall portion, wherein the engagement depression is formed by a depression component which is made in particular of plastics material and is inserted into an opening formed in the door lining and extends into a part of the door that is covered by the door top edge.

Finally, for achieving the mentioned object, a further approach provides that, according to the invention, the engagement structure is formed by an engagement web arranged in the height region of the first lining wall portion and extending in the vertical direction of the door, wherein the engagement web is formed on a web carrier component made in particular of plastics material, which is inserted into an opening formed in the door lining and extends into a part of the door that is covered by the door top edge.

BRIEF DESCRIPTION OF THE DRAWINGS

The invention will be explained further hereinbelow with reference to the accompanying drawings, in which:

FIG. 3 shows, schematically, a further exemplary embodiment of an engagement structure cooperating with a closing member.

DETAILED DESCRIPTION

Figure 1:
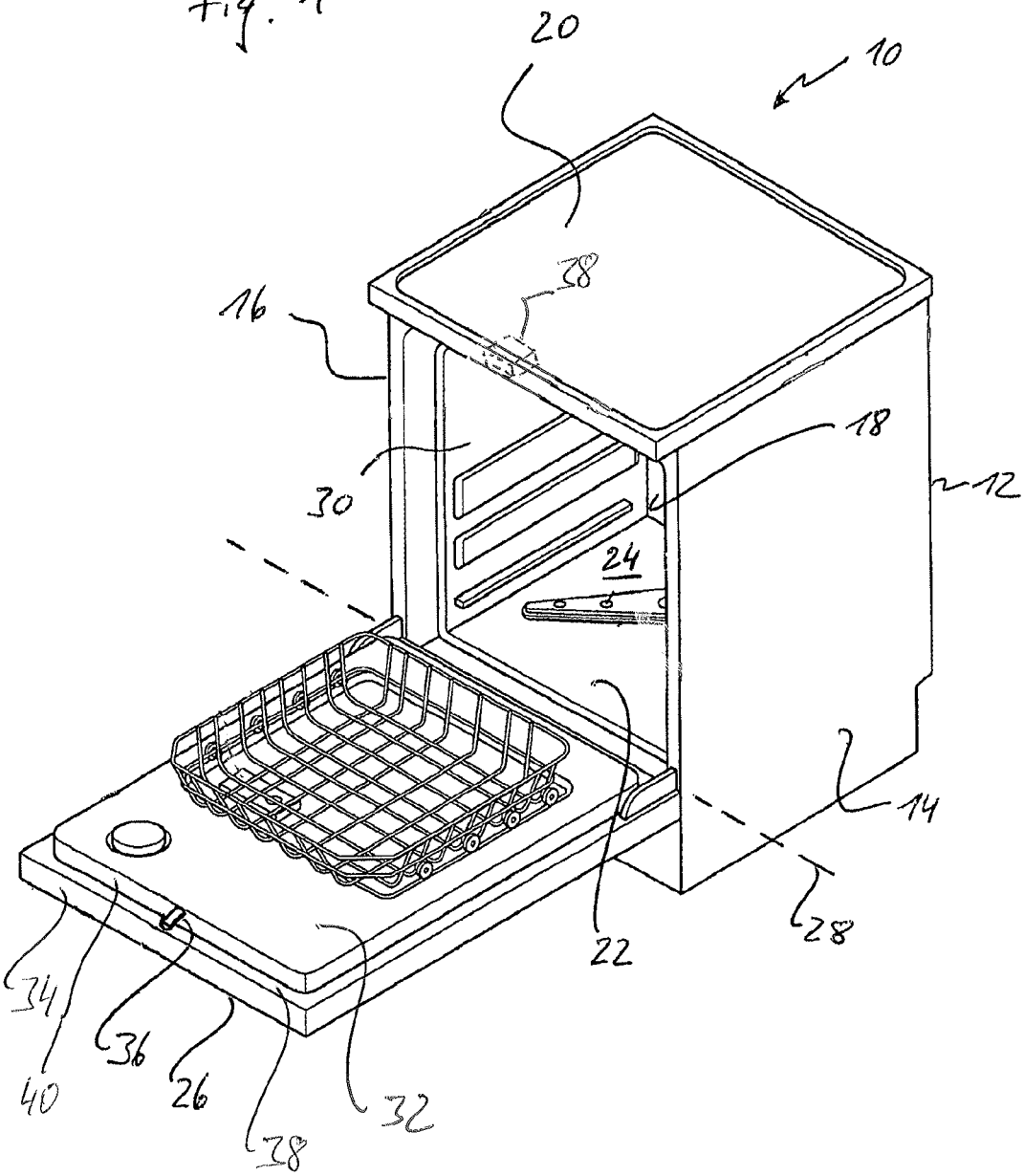
FIG. 1 shows, in a perspective view, a domestic dishwashing machine according to one exemplary embodiment.

Reference will first be made to FIG. 1. The dishwashing machine shown therein is generally designated 10. It comprises a dishwashing container (machine body) 12 in which there is formed a dishwashing chamber 24 defined between two opposing side walls 14, 16, a rear wall 18, a top wall 20 and a bottom wall 22 of the dishwashing container 12. A door 26 is mounted on the dishwashing container 12 so as to be pivotable about a horizontal pivot axis 28, denoted by a broken line, that is close to the floor. The door 26 serves to close an access opening 30, formed in the front of the dishwashing container, to the dishwashing chamber 24.

Figure 2:
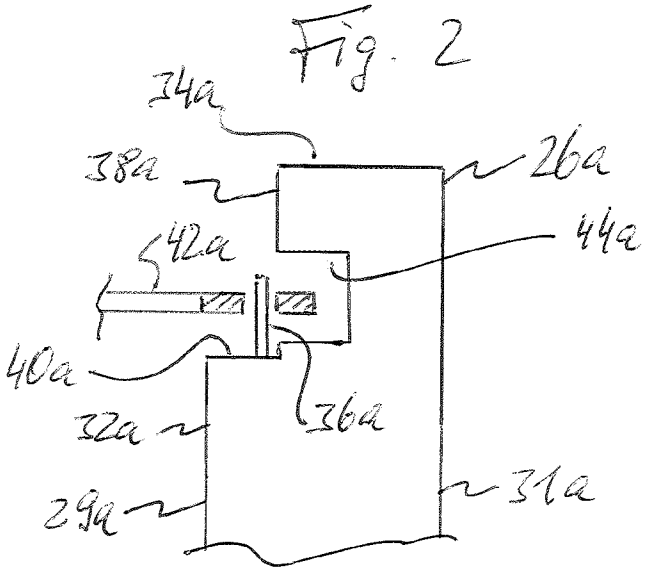
FIG. 2 shows, schematically, an exemplary embodiment of an engagement structure cooperating with a closing member to hold a door of the dishwashing machine closed.

The door 26 has an inner side 29 and an outer side 31 (see FIG. 2, 3). In the representation of FIG. 1, the outer side 31 of the door 26 is not visible; when the door 26 is fully open in the horizontal position, the outer side faces the floor on which the dishwashing machine 10 is standing. The inner side 29 faces the dishwashing chamber 24 when the door 26 is closed; the outer side 31 can also be referred to as the front side of the door 26 because, with the door 26 closed, it faces a user standing in front of the dishwashing machine 10. On its inner side 29, the door 26 has an inner lining 32, which is typically made of sheet-metal material and extends to a door top edge 34. The door top edge 34 is the edge of the door 26 that is directed upwards when the door 26 is closed, that is to say when its door plane is substantially vertical. At least in the case of fully integrated dishwashing machines, one or more display or/and control elements with which the user controls the dishwashing machine 10 are often set into the door top edge 34. On the opposite part of the periphery of the door 26, the door has a door bottom edge, which is not specifically designated in the figures and faces the floor when the door 26 is closed.

An engagement structure 36 is formed on the door 26, which engagement structure, on closing of the door 26, cooperates with a latch assembly 38 arranged on the dishwashing container 12 and indicated by a broken line in FIG. 1, in order to hold the door 26 closed. The engagement structure 36 and the latch assembly 38 together form a door latch of the dishwashing machine 10. The latch assembly 38 is fitted into the container roof (body roof), formed by the top wall 20, of the dishwashing container 12. On closing of the door 26, the engagement structure 36 comes into closing engagement with a movably arranged closing member of the latch assembly 38. The latch assembly 38 additionally has a closing spring arrangement which, on closing of the door 26, is relaxed and thus pulls the door 26 shut with compression of a door seal, which is not shown in detail in FIG. 1 and is applied to the inner lining 32 on closing of the door 26. In order to open the door 26 by hand, a user must apply sufficient force to overcome the holding-closed action of the closing spring arrangement. The closing member and closing spring arrangement are not shown in detail in FIG. 1, but exemplary configurations will become apparent from the further figures and the relevant explanations. The pin- or web-like configuration of the engagement structure 36 shown in FIG. 1 is also merely by way of example; although this configuration is referred to in the exemplary embodiments explained below, other exemplary embodiments are based on other configurations of the engagement structure 36.

Starting from the door top edge 34 and looking in a direction towards the door bottom edge, the inner lining 32 forms a first lining wall portion 38, which extends substantially parallel to the door plane of the door 26 and is adjacent to the door top edge 34. Adjoining this first lining wall portion 38 is a second lining wall portion 40, which has been produced together with the first lining wall portion 38 from a common sheet-metal piece and extends substantially perpendicular to the door plane in the direction away from the door 26. The two lining wall portions 38, 40 are thus substantially at a right angle to one another and form a step at which the inner lining 32 protrudes in the direction towards the dishwashing chamber 24 (considering a situation in which the door 26 is closed).

If the extent of this protrusion of the inner lining 32 is sufficiently great, the engagement structure 36 can be mounted wholly on the second lining wall portion 40 and at a sufficient distance from the first lining wall portion 38, in order that the mentioned closing member is able to engage behind the engagement structure 36 on closing of the door 26 without interfering with the first lining wall portion 38. If, however, it is required to reduce the extent of the protrusion of the inner lining 32 at the step from the first lining wall portion 38 to the second lining wall portion 40 because the volume available for accommodating dishes in the dishwashing chamber 24 is to be increased and therefore the door is to be designed with a reduced thickness, it can no longer be ensured that sufficient space remains behind the engagement structure 36 without the mentioned closing member interfering with the first lining wall portion 38 on closing of the door 26. Therefore, exemplary embodiments according to the invention provide that there is formed in the height region of the first lining wall portion 38 an insertion space which is covered by the door top edge 34 and into which the mentioned closing member can be inserted on closing of the door 26 so as to be able to engage behind the engagement structure 36. For a more detailed explanation of this and further aspects, reference will now be made to the further figures. In those figures, components or structures which are the same or have the same effect are provided with the same reference numerals as in FIG. 1, but with the addition of a lowercase letter. Unless otherwise indicated hereinbelow, reference is made to the above explanations of such components or structures which are the same or have the same effect.

The exemplary embodiment of FIG. 2 will next be explained. FIG. 2 shows, schematically, a vertical section through the door **26*a* in the region of the door top edge 34*a*. The engagement structure 36*a* is here of elongate form in the manner of a web or pin and extends in the vertical direction of the door 26*a*. Reference numeral 42*a* denotes a closing member, which can be part of the latch assembly 38 of FIG. 1. The closing member 42*a* can be in the form of, for example, a gripper which is movable in the plane of the top wall 20 of the dishwashing container 12 of FIG. 1 and which has a gripping mouth defined by two jaws. For further details of a door latch having such a gripper, reference may be made, for example, to DE 10 2016 008 044 B4, the content of which is hereby incorporated by explicit reference in its entirety. It will be seen that in the height region of the first lining wall portion 38*a*, covered by the door top edge 34*a*, there is formed an insertion space 44*a* into which the closing member 42*a* can be inserted on closing of the door 26*a*. The presence of the insertion space 44*a* allows the engagement structure 36*a* to move close to the first lining wall portion 38*a*-despite the reduced distance between the engagement structure 36*a* and the first lining wall portion 38*a*, the closing member 42*a* is still able to reliably engage behind the engagement structure 36*a* because it can use the insertion space 44*a* for that purpose. The reduced distance between the engagement structure 36*a* and the first lining wall portion 38*a* can in turn be used to reduce the thickness of the door 26*a*** overall.

In the exemplary embodiment of FIG. 3, the engagement structure **36*b*** is in the form of an engagement depression which is recessed relative to the second lining wall portion

40*b* and into which the closing member 42*b* can engage with a downwardly projecting closing lug 46*b*. For further details of a door latch having a closing member which, on closing of the door, is inserted with a closing lug into such an engagement depression, reference may be made, for example, to DE 10 2006 037 494 A1, the content of which is hereby incorporated by explicit reference in its entirety. It will be seen in FIG. 3 that the engagement depression 36*b* is not only formed in the second lining wall portion 40*b* but extends into a region of the door 26*b* that is covered by the door top edge 34*b*, so that, in the exemplary embodiment of FIG. 3 too, there is an insertion space 44*b* formed in the height region of the first lining wall portion 38*b* into which the closing member 42*b* can move on closing of the door 26*b* in order that it can come into closing engagement with the engagement depression 36*b*. The displacement of the engagement depression 36*b* in the direction towards the outer side 31*b* of the door 26*b* again makes it possible to reduce the thickness of the door 26*b*.

Accordingly, in the exemplary embodiments according to FIG. 2 and FIG. 3, it is possible, despite the reduced door thickness, to use conventional latch concepts, as are shown and described, for example, in the mentioned documents DE 10 2016 008 044 B4 and DE 10 2006 037 494 A1.

Figure 4:
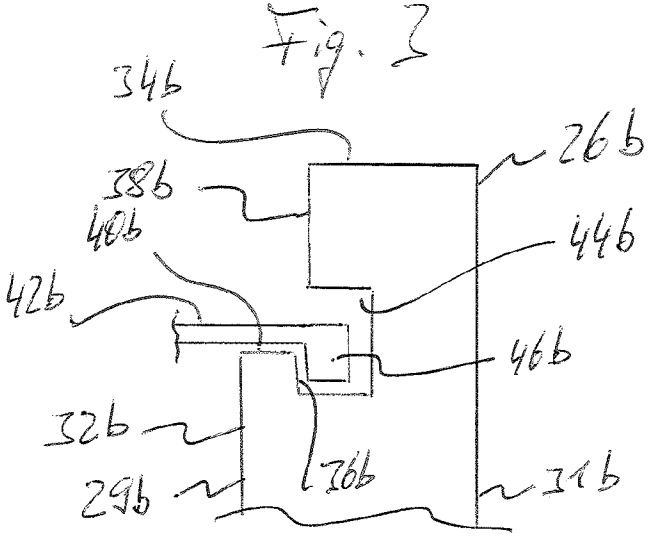
FIG. 4 is a perspective view of a detail of a door of a dishwashing machine having a web carrier component according to one exemplary embodiment.
Figure 4:
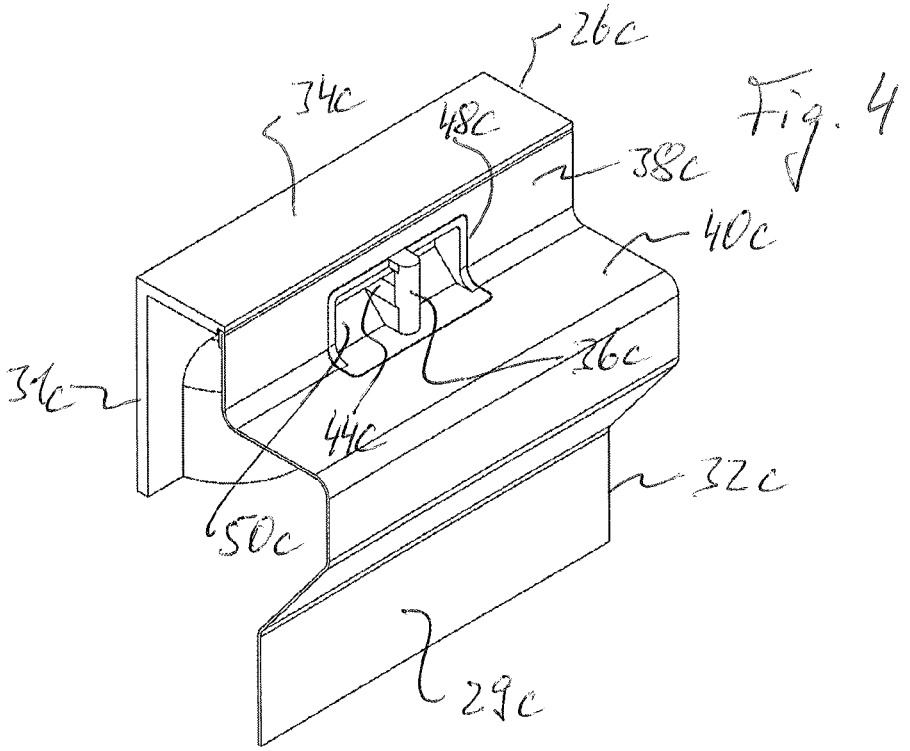
Figure 5:
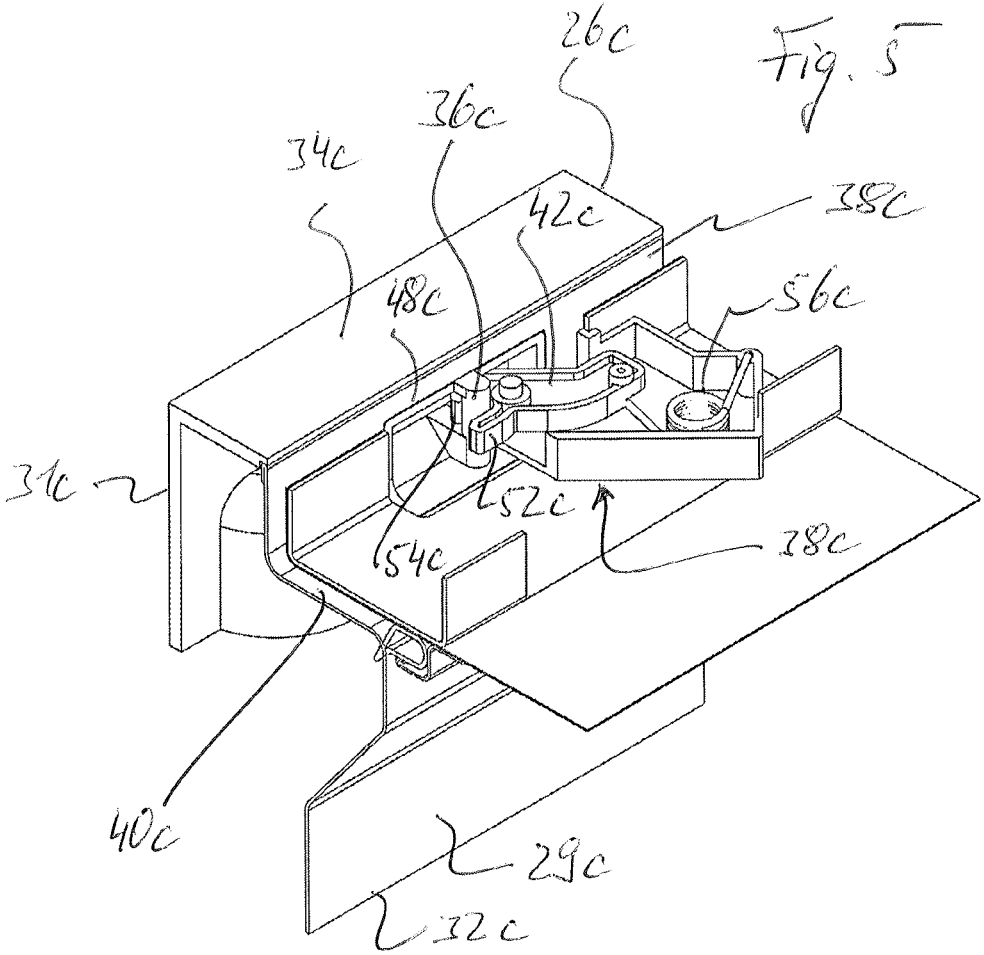
FIG. 5 shows the door detail of FIG. 4 supplemented with components of a latch assembly according to one exemplary embodiment.

Reference will next be made to FIG. 4 and FIG. 5. These figures show an exemplary embodiment which implements the structural and functional principle according to FIG. 2. As can be seen in FIG. 4, an opening 48*c* has been incorporated (for example by a punching process) into the inner lining 32*c*, into which opening a web carrier component 50*c* has been inserted. The web carrier component 50*c* can be held in the opening 48*c* by snap connecting means (not shown in detail), for example, or in another suitable way. It is an injection-molded plastics component, for example, and is not only the carrier for the engagement structure (engagement web) 36*c*, but also provides the insertion space 44*c*. The engagement structure 36*c* can be, for example, an integral component of the web carrier component 50*c*. The opening 48*c* is formed for the most part in the first lining wall portion 38*c* and extends beyond the interface between the first and second lining wall portions 38*c*, 40*c* into the region of the second lining wall portion 40*c*. In the inserted state, the web carrier component 50*c* protrudes into the region of the door 26*c* that is covered by the door top edge 34*c* and can thus provide the insertion space 44*c* with the required size.

According to FIG. 5, the latch assembly 38*c* comprises as the closing member 42*c* a rotary gripper having two gripping jaws 52*c*, 54*c* which grip the engagement structure 36*c* of web form between them when the door is closed. This state is shown in FIG. 5. It will be seen that the gripping jaw 54*c*, which engages behind the engagement structure 36*c* on closing of the door, utilizes and is inserted into the insertion space 44*c* formed in the web support component 50*c*. In the example shown, the latch assembly 38*c* additionally has a closing spring 56*c* which is coupled with the closing member 42*c* and which, on closing of the door 26*c*, generates a pulling-shut action and, when the door 26*c* is closed, opposes a holding-closed force to the opening thereof.

Figure 6:
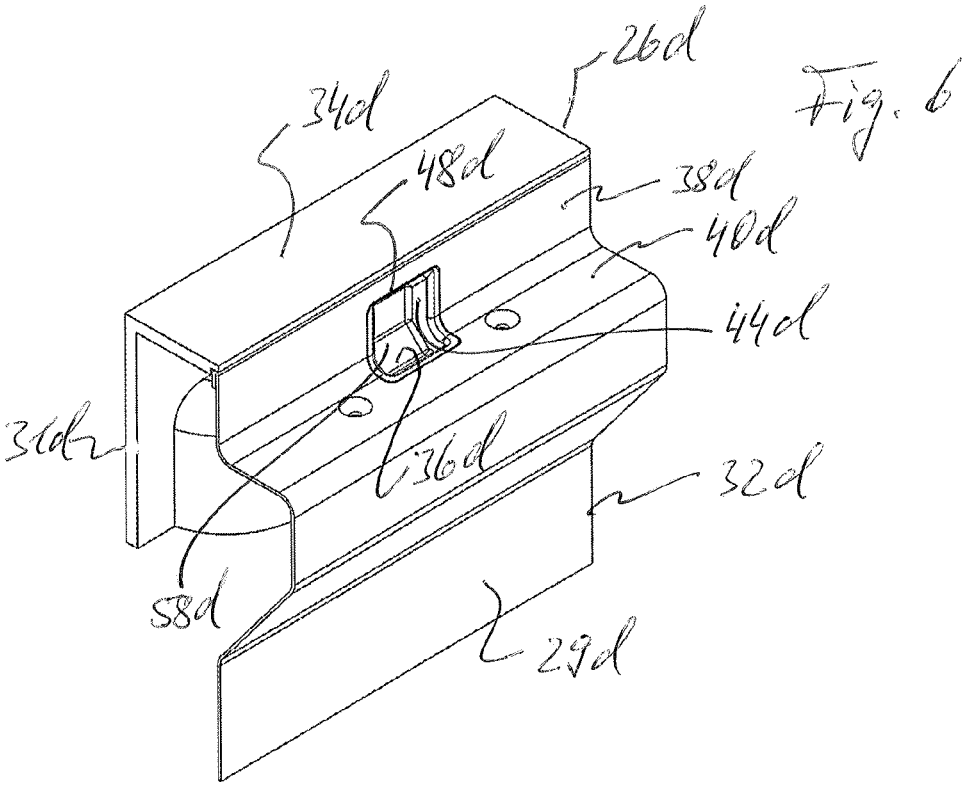
FIG. 6 is a perspective view of a detail of a door of a dishwashing machine having a depression component according to one exemplary embodiment.
Figure 7:
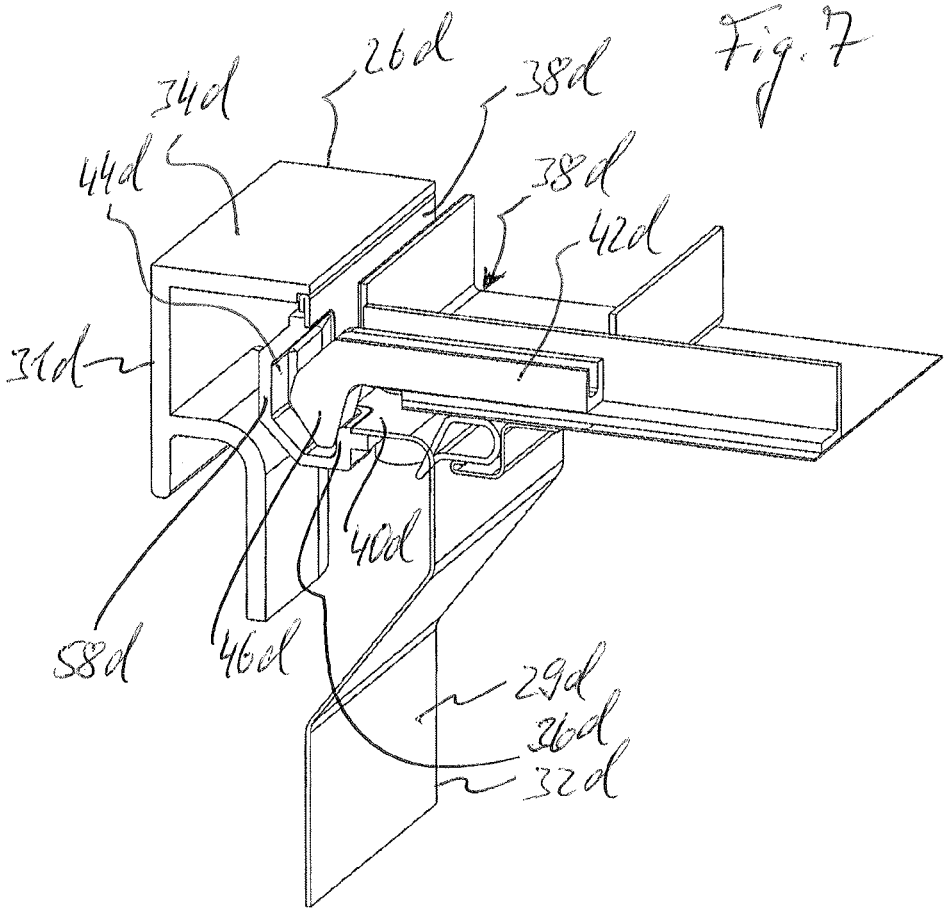
FIG. 7 shows the door detail of FIG. 6 supplemented with components of a latch assembly according to a further exemplary embodiment.

Finally, reference will be made to the exemplary embodiment according to FIG. 6 and FIG. 7, which implement the structural and functional principle of FIG. 3. According to FIG. 6, the opening 48*d* is again formed for the most part in the first lining wall portion 38*d*, but extends into the second lining wall portion 40*d*. A depression component 58*d* has been inserted into the opening 48*d*, which depression component forms an engagement depression serving as an engagement structure 36*d* together with the insertion space 44*d*, which is required by the closing member 42*d* on closing of the door 26*d* in order that the closing lug 46*d* of the closing member 42*d* can come into closing engagement with the engagement depression. The depression component 58*d* can again be an injection-molded plastics component, for example. Although not shown in detail in FIG. 7, the closing member 42*d* is also coupled with a closing spring (see, for example, the closing spring 94 of the mentioned DE 10 2006 037 494 A1), which performs a pulling-shut function on closing of the door 26*d* and the holding-closed force of which must be overcome in order to open the door 26*d*.

The invention claimed is:

1. A domestic dishwashing machine, comprising:

a machine body having a dishwashing chamber formed therein;

a door mounted on the machine body so as to be pivotable about a horizontal pivot axis; and a door latch, wherein the door latch comprises a latch assembly arranged on the machine body, and an engagement structure arranged on the door, wherein the latch assembly has a movably arranged closing member and a closing spring arrangement, wherein, on closing of the door, the closing member comes into closing engagement with the engagement structure, and a pulling-shut action is exerted on the door by relaxation of the closing spring arrangement, wherein the door comprises an internal door lining made of sheet-metal material which extends to a door top edge, wherein the door lining has a first lining wall portion arranged adjacent to the door top edge and extending in a plane that is substantially parallel to the door plane, wherein a second lining wall portion adjoins the first lining wall portion in the direction towards a door bottom edge, wherein the second lining wall portion extends transverse to the door plane in the direction away from the door, wherein there is provided in the height region of the first lining wall portion, in a part of the door that is covered by the door top edge, an insertion space for insertion of the closing member on closing of the door such that the closing member extends through the plane of the first lining wall portion.

2. The domestic dishwashing machine as claimed in claim 1, wherein there is formed in the door lining an opening in which an insert part carrying the engagement structure is held, wherein the opening is formed at least in part in the first lining wall portion.

3. The domestic dishwashing machine as claimed in claim 2, wherein the opening extends from the first lining wall portion into the second lining wall portion.

4. The domestic dishwashing machine as claimed in claim 1, wherein the engagement structure is formed by an engagement depression which is recessed relative to the second lining wall portion, wherein the engagement depression is formed by a depression component which is inserted into an opening formed in the door lining and extends into a part of the door that is covered by the door top edge.

5. The domestic dishwashing machine as claimed in claim 1, wherein the engagement structure is formed by an engagement web arranged in the height region of the first lining wall portion and extending in the vertical direction of the door, wherein the engagement web is formed on a web carrier component which is inserted into an opening formed in the door lining and extends into a part of the door that is covered by the door top edge.

6. The domestic dishwashing machine as claimed in claim 1, wherein the first lining wall portion and the second lining wall portion forming a steplike part, wherein the engagement structure is positioned at least on or in the second lining wall portion.

7. A domestic dishwashing machine, comprising:

a machine body having a dishwashing chamber formed therein;

a door mounted on the machine body so as to be pivotable about a horizontal pivot axis; and a door latch, wherein the door latch comprises a latch assembly arranged on the machine body, and an engagement structure arranged on the door, wherein the latch assembly has a movably arranged closing member and a closing spring arrangement, wherein, on closing of the door, the closing member comes into closing engagement with the engagement structure, and a pulling-shut action can be exerted on the door by relaxation of the closing spring arrangement, wherein the door comprises an internal door lining made of sheet-metal material which extends to a door top edge, wherein the door lining has a first lining wall portion arranged adjacent to the door top edge and extending in a plane that is substantially parallel to the door plane, wherein a second lining wall portion adjoins the first lining wall portion in the direction towards a door bottom edge, wherein the second lining wall portion extends transverse to the door plane in the direction away from the door, wherein there is formed in the door lining an opening in which an insert part carrying the engagement structure is held, wherein the opening is formed at least in part in the first lining wall portion, wherein the closing member extends through the plane of the first lining wall portion.

8. The domestic dishwashing machine as claimed in claim 7, wherein the first lining wall portion and the second lining wall portion forming a steplike part, wherein the engagement structure is positioned at least on or in the second lining wall portion.

9. A domestic dishwashing machine, comprising:

a machine body having a dishwashing chamber formed therein;

a door mounted on the machine body so as to be pivotable about a horizontal pivot axis; and a door latch, wherein the door latch comprises a latch assembly arranged on the machine body, and an engagement structure arranged on the door, wherein the latch assembly has a movably arranged closing member and a closing spring arrangement, wherein, on closing of the door, the closing member comes into closing engagement with the engagement structure, and a pulling-shut action can be exerted on the door by relaxation of the closing spring arrangement, wherein the door comprises an internal door lining made of sheet-metal material which extends to a door top edge, wherein the door lining has a first lining wall portion arranged adjacent to the door top edge and extending substantially parallel to the door plane, wherein a second lining wall portion adjoins the first lining wall portion in the direction towards a door bottom edge, wherein the second lining wall portion extends transverse to the door plane in the direction away from the door, wherein one of the following applies:

(a) the engagement structure is formed by an engagement depression which is recessed relative to the second lining wall portion, the engagement depression being formed by a depression component which is inserted Into an opening formed in the door lining and extends into a part of the door that is covered by the door top edge, and (b) the engagement structure is formed by an engagement web arranged in the height region of the first lining wall portion and extending in the vertical direction of the door, the engagement web being formed on a web carrier component which is inserted into an opening formed in the door lining and extends into a part of the door that is covered by the door top edge.

* * * * *